United States Patent [19]

Schultz

[11] Patent Number: 4,844,751

[45] **Date of Patent: * Jul. 4, 1989**

[54] METHOD FOR MANUFACTURING A PERMANENT MAGNET MATERIAL FROM STARTING COMPONENTS IN POWDER FORM

[75] Inventor: Ludwig Schultz, Bubenreuth, Fed. Rep. of Germany

[73] Assignee: Siemens Aktiengesellschaft, Berlin & Munich, Fed. Rep. of Germany

[ * ] Notice: The portion of the term of this patent subsequent to Apr. 5, 2005 has been disclaimed.

[21] Appl. No.: 28,240

[22] Filed: Mar. 23, 1987

[30] Foreign Application Priority Data

Mar. 27, 1986 [DE] Fed. Rep. of Germany ..... 3610475

[51] Int. Cl.[4] ..... H01F 1/06

[52] U.S. Cl. ..... 148/105; 419/12; 419/23

[58] Field of Search ..... 148/103, 105; 419/12, 419/23

[56] References Cited

U.S. PATENT DOCUMENTS

| | | | |
|---|---|---|---|
| 3,785,801 | 1/1974 | Benjamin | 75/0.5 BC |
| 4,541,877 | 9/1985 | Stadelmaier et al. | 419/12 |
| 4,601,875 | 7/1986 | Yamamoto et al. | 419/12 |
| 4,735,770 | 4/1988 | Schultz et al. | 419/23 |

FOREIGN PATENT DOCUMENTS

| | | |
|---|---|---|
| 0126802 | 5/1984 | European Pat. Off. . |
| 0144112 | 12/1985 | European Pat. Off. . |

OTHER PUBLICATIONS

Benjamin, J.S., "Mechanical Alloying", *Scientific American,* vol. 234, No. 5, May 1976, pp. 40–48.

Givord, D. et al., "Magnetic Properties of $Y_2Fe_{14}B$ and $Nd_2Fe_{14}B$ Single Crystals", *Solid State Communications,* 51:11, pp. 857–860, 1984.

Herbst, J. F. et al., "Relationships Between Crystal Structure and Magnetic Properties in $Nd_2Fe_{14}B$", *Physical Review B,* 29, 4176, 1984.

Chemical Abstracts, vol. 103, 1985, 152451f.

Chemical Abstracts, vol. 83, 1975, 31785 c.

J. Appl. Phys. 57(1), Apr. 15, 1985, pp. 4149–4151, "Alternative Methods of Preparing High Coercivity Neodymium–Iron–Boron Magnets", Stadelmaier et al.

Appl. Phys. Lett., 46 (8), Apr. 15, 1985, pp. 790–791, "Hot-Pressed Neodymium Iron Boron Magnets", R. W. Lee.

Metallurgical Transactions, vol. 5, Aug., 1974, pp. 1929–1934 "The Mechanism of Mechanical Alloying", J. S. Benjamin et al.

*Primary Examiner*—Upendra Roy
*Assistant Examiner*—George Wyszomierski
*Attorney, Agent, or Firm*—Kenyon & Kenyon

[57] ABSTRACT

A permanent-magnet material of a metal/metal/metalloid system is produced in which at least one starting component of the metals in powder form is mixed together with a component in powder form of elemental boron, or a boron compound or alloy, is optionally compacted, and finally subjected to an annealing treatment for forming the permanent-magnet material. In order that a powder of this material system is produced with an extremely fine microstructure, the powder mixture of the starting components is first subjected to a milling process in the manner of mechanical alloying whereby a mixture powder of the at least one metallic starting component with embedded or adsorbed fine particles of the boron component is formed.

18 Claims, No Drawings

METHOD FOR MANUFACTURING A PERMANENT MAGNET MATERIAL FROM STARTING COMPONENTS IN POWDER FORM

FIELD OF THE INVENTION

This invention relates to a method for manufacturing a permanent magnet material of a metal/metal/metalloid system, in which at least one powdered starting component of the metals, together with a powdered starting component of elemental boron or a boron compound or alloy, is mixed, optionally compacted, and finally subjected to an annealing treatment for forming the permanent magnet material.

BACKGROUND OF THE INVENTION

A method of the type described above is disclosed, for instance, in the publication *Journal of Applied Physics*, Vol. 57, No. 1, Apr. 15, 1985, pages 4149 to 4151. For some time, new permanent magnet materials of metal/metal/metalloid systems have been known which exceed by far all materials known to date with respect to the most important hard-magnetic variable, namely, the energy product. Preferred materials of these systems have substantially the composition $Nd_2Fe_{14}B$, wherein a partial substitution of the mentioned elements or slight deviations from the stoichiometry of this tetragonal phase are possible in order to thus optimize the microstructure of the materials. For the manufacturer of such permanent magnet materials on a large technical scale, in particular, two methods are used. According to the method of European Patent EP 0 126 802 A1, an alloy of the desired composition is first melted, subsequently comminuted to form a fine pulver, magnetically oriented in a magnetic field, and then compacted by a pressure and sintering treatment. In the method disclosed in European Patent EP 0 144 112 A1, an intermediate product is first produced by fast quenching from the melt of the starting components, which is then compacted by hot pressing, and thereafter oriented in a further process step, the so-called "die-upsetting", in the preferred magnetic direction. See, for example, *Applied Physics Letters*, Vol. 46, No. 8, Apr. 15, 1985, pages 790 and 791. Materials which have been produced according to these two methods differ primarily with respect to their microstructure. While in the method of EP 0 126 802 A1, a relatively coarse grain structure with several foreign phases develops, the samples which were quenched fast according to the EP 0 144 112 A1 method are characterized by an extremely fine grain structure which in this case causes the anchoring of the Bloch walls, responsible for a magnetization reversal.

Besides these two methods, it is known from the *Journal of Applied Physics*, Vol. 57, No. 1, pages 4149 to 4151 (1985) that for the manufacture of permanent magnet material to use as the starting components Fe—, $Fe_2B$— and Nd— powder which are subsequently compacted and sintered. In the process, the desired phase is formed by diffusion. In order to obtain a magnetically anisotropic material, however, this sintered material must subsequently be comminuted again and, after magnetic orientation, compacted and sintered again. Thus, this prior art method for the manufacture of permanent-magnet materials with magnetic anisotrophy is relatively expensive.

OBJECTS OF THE INVENTION

It is therefore an object of the present invention to improve the previously discussed prior art in such a manner that a powder of the discussed material system which has an extremely fine microstructure, similar to that of fast-quenched material, can be produced in a simple manner and can optionally be compacted to form a body of magnetically oriented material by methods known per se. These and other objects of the present invention will become apparent from the following description and claims.

SUMMARY OF THE INVENTION

According to the present invention, the powder mixture of the starting components is first subjected to a milling process in the manner of mechanical alloying, wherein a mixed powder of at least one metallic starting component with embedded or adsorbed or attached fine particles of the boron component is formed. Powders are understood here to also include, very generally, bodies, particles, etc., such as fillings, which have forms similar to powder.

The advantages connected with this embodiment of the method of the present invention are, in particular, that the powder mixture so obtained can be compacted without difficulty in a manner known per se and subjected to an annealing treatment at a relatively low temperature for forming the desired magnetically hard phase. A preceding sintering or melting process with subsequent comminution of the material is therefore not necessary. Nevertheless, extremely fine powders can be obtained by the milling process.

DETAILED DESCRIPTION

This invention will be explained in further detail particularly with reference to the production of a special magnetically hard metal/metal/boron ($M_1M_2B$) alloy.

In this type of alloy, $M_2$ is chosen from the group of the late transition metals of the periodic system of the elements. $M_1$ is a rare earth metal or an actinide. The corresponding metallic starting component should be in powder form or at least have a powder-like appearance, wherein they can preferably be present in elemental form or optionally also in the form of alloys or compounds. $M_1$ and $M_2$ can be in particular the metals neodymium (Nd) and iron (Fe). An example of one embodiment of the present invention employing the ternary alloy NdFeB will be described.

For manufacturing powder of these NdFeB alloys, powders of the two metallic starting components Fe and Nd as well as B-powder are placed together with hardened steel balls in a suitable milling cup. The mass ratio of the three types of powder of this powder mixture is determined by the predetermined resulting atom concentration of the material desired to be produced from these powders. Thus, the mass ratio of the three elemental types of powder of this powder mixture can be chosen so that after a diffusion reaction is carried out, the composition $Nd_{15}Fe_{77}B_8$ has been produced. Generally the content of Nd can be between 10 and 20 atom percent and that of B, between 2 and 10 atom percent, the Fe content essentially accounting for the remainder.

While the size of the individual powder can be arbitrary, a similar size distribution of the two participating metallic starting components in a range between about 5 $\mu$m and about 1 mm and preferably between about 20

μm and about 0.5 mm is advantageous. In this example, Fe powder with a particle size under 40 μm and Nd fillings with a particle size under 0.5 mm are used. In addition, the B-powder should be as fine as possible. Advantageously, the B-powder particles have an extent of less than about 10 μm and preferably less than about 1 μm. Suitably, this may be largely amorphous B powder. In accordance with the present invention, these three powders with corresponding particle sizes are then subjected to a milling process such as is generally known in processes of mechanical alloying. See, for example, *Metallurgical Transactions* Vol. 5, August 1974, pages 1929 to 1934, or *Scientific American*, Vol. 234, 1976, page 40 to 48. Accordingly, the three starting components in powder form are thus placed in a planetary ball mill, e.g., Trade Mark Fritsch: Type "Pulverisette 5", which may have, for example, 100 steel balls with diameters of 10 mm each. The duration of the milling process depends on the desired fineness of the mixture powder as well as on the milling parameters. Important parameters during the milling are the ball diameter, the number of balls, as well as the material of the milling crucible and the ball material. Also, the milling rate, the ratio of the steel balls, and the amount of powder are further parameters which determine the required milling duration. In order to prevent surface oxidation of the particles, the milling vessel, fabricated from steel, is kept in a protective gas atmosphere such as argon or helium and is opened again only after the milling process is completed.

During the milling process, finely stratified powder grains, comprising Fe and Nd layers, are already formed after a milling time of about two hours. In the process, the boron particles are embedded at the Fe/Nd boundary surfaces as well as in the elemental metal or adsorbed thereon. With advancing milling time, this layer structure gets finer and finer until, after a milling time of about 10 to 30 hours, it can no longer be resolved by a light microscope. Thus, powder particles of a mixture powder have then been generated which comprise an intimate mixture of Fe and Nd with embedded or adsorbed or attached boron particles, the size of which is distinctly smaller than 1 μm. The powder particles themselves have a diameter of about 1 to 200 μm. In X-ray examinations of this mixture powder, only a greatly widened intensity maxima of Fe can be seen. There are no references to the formation of amorphous FeNd or an FeNd phase.

The subsequent reaction anneal must likewise take place in a protective gas or in a vacuum. The anneal can be performed at one or several different temperatures. The annealing may suitably take place at a temperature between about 400° C. and about 640° C. A continuous temperature change is also possible. With an annealing treatment of, for instance, 1 hour at 600° C., the desired $Nd_2Fe_{14}B$ phase which has excellent magnetically hard properties is formed by a diffusion reaction. Thus, after embedment in plastic, the reacted powder exhibits a coercivity of more than 10 kOe.

A significant advantage of the method according to the present invention is in that an extremely good mixture of the participating elements exists with the milling process in the manner of mechanical alloying. Thus, only very short diffusion paths which can be overcome at relatively low temperatures or short times are required in the subsequent diffusion reaction. It is therefore possible to obtain an extremely fine microstructure of the $Nd_2Fe_{14}B$ phase which corresponds, for instance, to that of a fast quenched material. The magnetic hardening of this material accordingly takes place by Bloch wall anchoring. It is a particular advantage there that the annealing can take place at temperatures below about 640° C., the lowest eutectic temperature in the binary FeNd phase diagram. A rapid grain increase would take place above this temperature because of the existence of a liquid phase. For the mentioned ternary magnetically hard material, a reaction temperature between about 400° C. and 640° C. seems best.

Optionally, an anneal at higher temperatures such as 900° C. for one hour, likewise leads to good values of the coercivity. The powder formed in this process, however, is relatively coarse-grained; it has foreign phases at the grain boundaries and exhibits a magnetic hardening mechanism which is influenced by the inhibited domain seed formation. It thus resembles the material which is prepared in accordance with the referenced EP 0 126 802 A1 and can then be processed further in a manner known per se to form an anisotropic magnet. The temperature treatments known from the European Patent can also be used to advantage for this purpose.

The compacting and adjustment of the magnetic anisotropy of the NdFeB particles which, according to the present invention, are formed at relatively low temperatures and the structure of which corresponds to that of rapidly quenched NdFeB, can be performed in the manner known per se by the processes developed for these materials.

However, this powder also can be used without compacting, for example, as a plastic-bonded isotropic magnet.

The composition of the material on which the example was based can deviate, when the materials are being weighed out, from the stoichiometric composition $Nd_2Fe_{14}B$, for instance, in such a manner as is customary for the methods known from the referenced publications. In addition, one or more of the three participating elements can be substituted partially or optionally, even completely, by other elements. Thus, for instance, Nd can be particularly substituted partially by an element of the heavy rate earths such as Dy or Tb or, for example, completely by Pr. Instead of Fe, another element of the late transition metals such as Co or Ni can be used. Partial substitution by Al is also possible. B can be partially substituted by another metalloid. The starting powders used depend on the desired compositions. With respect to the diffusion process, it is particularly advantageous for thermodynamic reasons if elemental powders are used because there, the driving force for the diffusion reaction is a maximum. For the same reason, the use of amorphous B-powder is particularly advantageous. In addition, the participating elements can also be added in the form of pre-alloyed powder, for instance, as $Fe_2B$ or as an NdFe phase or an NdFe alloy with 20 to 40 atom percent Fe.

In selecting the pre-alloys, the metastable phases are again to be preferred over the equilibrium phase for the stated thermodynanic reasons.

According to the selected embodiment, it was assumed that at least two metallic starting components $M_1$ and $M_2$ are provided in powder shape, wherein each of these two components comprises a metallic (chemical) element or an alloy of several compounds of this element. It is also possible, however, to start off with only one single powder-shaped alloy of the two starting metals $M_1$ and $M_2$, i.e., the alloy $M_1$-$M_2$ alone then supplies the two metallic components of the permanent magnet material. In the case of $Nd_2Fe_{14}B$, this could be the alloy $Nd_{16}Fe_{84}$ in powder form, which together with the B-powder, constitutes the powder mixture to be milled.

Although preferred embodiments of the present invention have been discussed in detail, it will be appreciated by one skilled in the art that modifications may be made all within the spirit and the scope of the present invention as defined in the claims.

What is claimed is:

1. In a method for the production of a permanent magnet material with a crystalline structure of a metal-metal-metalloid system comprising mixing at least one powdered metallic starting component together with a powdered starting component containing boron forming a powder mixture and subjecting the mixed starting components to an annealing treatment for forming the permanent magnet material, the improvement comprising:

subjecting the powder mixture of the starting components to a mechanical alloying milling process thereby forming a mixture powder of the at least one metallic starting component with embedded or absorbed fine particles of the boron component wherein, said boron starting component is a member selected from the group consisting of elemental boron, a boron compound, and a boron containing alloy, and said boron starting component has particle sizes less than about 10 μm, and wherein, said mixture powder is comprised of particles and the said starting components are not resolvable in said mixture powder particles by a light microscope.

2. A method according to claim 1 wherein said mixed starting components are compacted prior to being subjected to the annealing treatment.

3. A method according to claim 1 wherein at least two powdered metallic starting components are provided, and wherein said at least two metallic starting components are intimately mixed by said milling process and in which starting components the particles of the boron component are embedded.

4. A method according to claim 3 wherein said metallic starting components are selected from the group consisting of elemental metals, metal compounds and metal alloys.

5. A method according to claim 1 wherein said at least one metallic starting component is an alloy of two metals.

6. A method according to claim 1 wherein a first metallic starting component is chosen from the transition metals of the periodic table of the elements.

7. A method according to claim 6 wherein a second metallic starting component is selected from the group consisting of rare earth metals and actinides.

8. A method according to claim 6 wherein the powdered metallic starting components are neodymium (Nd) and iron (Fe) and the starting components are selected in amounts to provide a permanent magnet material containing between about 10 and about 20 atom percent neodymium, between about 2 and 10 atom percent boron, with the balance essentially iron.

9. A method according to claim 8 wherein the powdered mixture of the starting components is milled for at least 2 hours.

10. A method according to claim 9 wherein the powdered mixture of the starting component is milled for between about 10 and about 30 hours.

11. A method according to claim 3 wherein the annealing treatment is carried out at between about 400° C. and about 640° C.

12. A method according to claim 8 wherein there is a partial substitution of at least one of the elements selected from the group consisting of Nd, Fe and B by another element from the same group in the periodic table of the elements.

13. A method according to claim 1 wherein the powdered metallic starting component has particle sizes between about 5 μm and about 1 mm.

14. A method according to claim 13 wherein the powdered metallic starting component has particle sizes between about 20 μm and about 0.5 mm.

15. A method according to claim 14 wherein the boron containing starting component has particle sizes less than about 1 μm.

16. A method according to claim 1 wherein the boron containing starting component is amorphous boron powder.

17. A method according to claim 1 wherein at least two powdered metallic starting components are provided, and wherein said at least two metallic starting components are intimately mixed by said milling process and to which starting components the particles of the boron component are adsorbed.

18. A method according to claim 1 wherein the powdered metallic starting components are neodymium (Nd) and iron (Fe) and the starting components are selected in amounts to provide a permanent magnet material having a Nb-Fe-B composition.

* * * * *